United States Patent [19]

Klein

[11] Patent Number: 4,976,368

[45] Date of Patent: Dec. 11, 1990

[54] CONCENTRIC CONVENIENCE OPENING BEVERAGE CAN END

[76] Inventor: Gerald B. Klein, 13451 Stuart Ct., Broomfield, Colo. 80020

[21] Appl. No.: 425,309

[22] Filed: Oct. 23, 1989

[51] Int. Cl.[5] ..... B65D 17/32

[52] U.S. Cl. ..... 220/268; 220/380; 222/541

[58] Field of Search ..... 220/266, 267, 268, 380; 222/541

[56] References Cited

U.S. PATENT DOCUMENTS

| | | | |
|---|---|---|---|
| 2,367,300 | 1/1945 | McManus et al. | 220/268 |
| 3,334,775 | 8/1967 | Klein et al. | 220/268 |
| 3,929,251 | 12/1975 | Urmston | 220/268 |
| 4,244,490 | 1/1981 | Klein | 220/268 |
| 4,648,528 | 3/1987 | LaBarge et al. | 220/268 X |

*Primary Examiner*—Stephen Marcus
*Assistant Examiner*—Nova Stucker
*Attorney, Agent, or Firm*—Dennis O. Kraft

[57] ABSTRACT

A beverage can end of drawn metal is provided with a lipped opening upstanding from the expansion panel of the end. The expansion panel may be convex, flat or concave. The lipped opening is proportioned to facilitate drinking and pouring from a can. A height of the lip of 0.25 inches is sufficient for this purpose. The lip is formed as a circular wall with a pushdown gate positioned within the lip, the gate being mounted on a seating and hinging means which preferably is a triplefold of drawn metal. The hinging and seating means within the lip is of a smaller diameter than the lip wall, and is supported by a bridging means connecting with the top of the lip wall. The bridging means includes a circular panel and may include an inner wall portion. In a first embodiment, the circular panel is the top of the lipped opening and the seating and hinging means is at the base of an inner wall, whose top is at the inner edge of the circular panel to space the inner wall from the outer wall. In a second embodiment, the inner wall is not present and the seating and hinging means is at the inner edge of the circular panel and at the top of the lipped wall. In a third embodiment, an inner wall is closely adjacent to the top portion of the lip wall and a circular spacer panel extends inwardly from the bottom of the inner wall to carry the seating and hinging means at its inner edge.

33 Claims, 3 Drawing Sheets

CONCENTRIC CONVENIENCE OPENING BEVERAGE CAN END

BACKGROUND OF THE INVENTION

This invention relates to can ends and, more particularly to a beverage can end having a concentric lipped-spout opening for drinking or pouring the contents of the can.

Can ends having central openings are known to the art, as described in my U.S. Pat. No. 4,244,490. As disclosed therein, a centered conical frustum was drawn in the can with the apex end forming an orifice. That patent also discloses a pushdown gate in the apex of the cone such as the triplefold gate disclosed in U.S. Pat. No. 3,334,775 to myself and Kenneth E. Harper. Other types of cans having conical ends with crown or cap closures have been used and are desirable because they have drinking and pouring characteristics comparable to bottles.

As beverage cans became popular and widespread, flat top ends gradually dominated the market. Economic packaging and manufacturing factors were largely responsible for this. At first, the cans were opened with can openers but at present most cans are provided with an eccentric opening near the edge of the can end. These edge openings are gated by pull tabs or push-in tabs and the common type, now in general use, is a lever operated push-in tab.

The present ends, having lever operated push-in tabs, are unsatisfactory for a number of reasons including consumer dissatisfaction and a high manufacturing cost.

The improved end unit, drawn from a flat metal material, as herein disclosed, was conceived and developed to overcome the disadvantages of the present ends. The advantages and objectives of this improved end unit are designed to provide a can end having a concentric convenience opening which has better drinking and pouring characteristics, which has a better appearance for a beverage can, and which has a pushdown gate in the aperture arranged to permit the can to be held and opened with one hand.

A further important objective is to reduce the cost of can ends and the present invention can reduce this cost by as much as 40 percent.

First, there is a significant reduction in metal usage. Beverage cans 2 11/16 inches in diameter are presently necked in at the top to a diameter of 2 6/16 inches (206 industrial designation), which is the maximum reduction practicable with lever-operated openings in the ends. The reason for necking is to permit a reduced diameter of the end unit in order to save metal. This, in turn, permits a reduction in the thickness of the metal forming the unit. The present invention, an end with the centered opening, permits a significant further reduction in the diameter of the top of the can body, with a further reduction of end diameter and thickness. The present industrial necking machinery is capable of necking a can body down to a 2-inch diameter opening. The improved end may be used with this 2-inch diameter opening or even a smaller opening with modified necking machinery. A further reduction in metal usage is effected in elimination of the levers per se and this elimination of levers permits a reduction in the end unit countersink depth. Altogether, the present invention permits metal usage reduction in four areas affecting a metal cost savings of more than 25 percent.

Secondly, in addition to metal usage savings, a 10 to 15 percent savings is possible in manufacturing costs. The manufacture of the improved concentric ends is greatly simplified because a single press is required as opposed to the present 2-press systems. The cost of tooling is greatly reduced because all components are concentric and tooling can be produced with ordinary machine shop equipment in contrast with the special machines needed to produce the present eccentric tooling. In addition to being less costly, concentric tooling is more durable.

Thirdly, much wider tolerances are permissible with the improved end than are permissible with the present lever operated eccentric opening ends. For example, the score depths on the present ends must be held to very close tolerances. The score depth tolerance on the improved end is so great as to be of no special consideration. Altogether, this simplification of the manufacturing process results in improved manufacturing reliability with its consequent spoilage reduction, reduction in maintenance down time, and an increase in quality level assurance.

Fourthly, it is to be noted that the improved end may be manufactured from either aluminum or steel as opposed to present convenience opening ends which can be manufactured only of aluminum.

SUMMARY OF THE INVENTION

There is a real and definite need for an improved can end having the above noted advantages and also the same packaging and dispensing advantages of a flat can end. The present invention, to meet this need, comprises, in essence, a can end having an upstanding circular lipped opening at the center of the end expansion panel. A pushdown gate within the aperture forms the convenience opening means. The expansion panel circumscribing the opening may be dished to convex upwardly, it may be flat, or it may even be dished to concave slightly downwardly.

Flow from this simplified can end was found to be superior in drinking characteristics as compared with any eccentric opening near the edge of the end. Moreover, an unexpected result was the discovery that a lipped opening high enough to provide superior drinking and pouring characteristics was possible without materially increasing the overall conventional can height. This becomes important where cans are machine dispensed as in coin operated vending machines. Also, it was found that the proximity of the peripheral seaming rim connecting the can end to the can body does not disrupt nor interfere with drinking from the centered lipped opening. Also, it was found that a small flange about the top of the opening provides a better purchase for the mouth of a person drinking from the can and provides a drip edge when pouring a beverage from the can.

BRIEF DESCRIPTION OF THE DRAWINGS

In further detail, my invention comprises certain constructions, combinations, and arrangements of parts and elements as hereinafter described, defined in the appended claims, and illustrated in preferred embodiments in the accompanying drawings, in which:

DETAILED DESCRIPTION OF PREFERRED EMBODIMENTS

Figure 1:
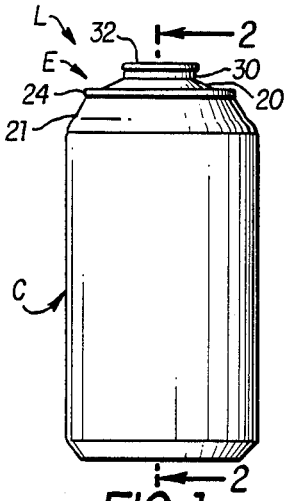
FIG. 1 is an elevational view of a beverage can body having a necked-down top opening closed by a can end with a lipped opening upstanding from the center of a convexed expansion panel of the end.
Figure 2:
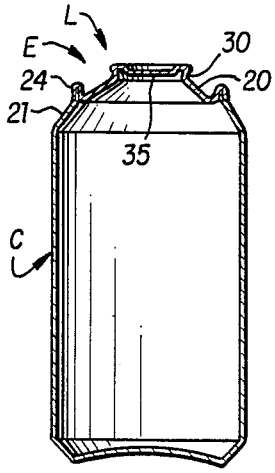
FIG. 2 is a sectional view as taken from the indicated line 2—2 at FIG. 1.

Referring more particularly to the drawing, the can body C is closed by a circular end E having a lipped opening L upstanding from the center of the expansion panel 20 of the can end E. The can body may be of aluminum or steel, drawn and shaped in a conventional, standardized manner. Preferably, the open top of the cylindrical can body wall is necked in as at 21 to reduce the diameter of the opening. A double-seam body hook 22 at the top edge of the necked-in portion 21 is interlocked with the end hook 23 forming a conventional double seam 24. The reduction in diameter of the can by the necked-in portion 21 reduces the necessary diameter of the can end and, at the same time, reduces the thickness of metal necessary for the end to resist the pressure of the beverage within the can as when it is carbonated, thereby reducing metal usage.

It is to be noted that with the improved end E, the necking of the can body top can be further increased to reduce the opening diameter, the end E diameter, and the end metal thickness to a greater extent than is practical with an end having a lever-operated eccentric opening.

Figure 4:
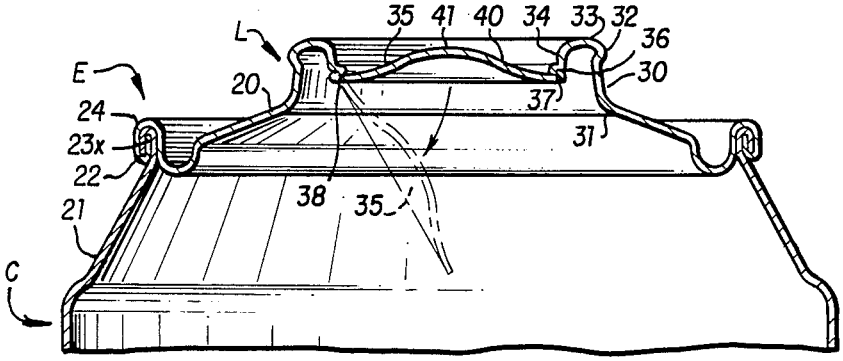
FIG. 4 is a fragmentary, enlarged portion of the section shown at FIG. 2 to better illustrate the manner in which the can end is attached to the can body and with the pushdown gate closing the opening being shown partially open in broken lines.
Figure 5:
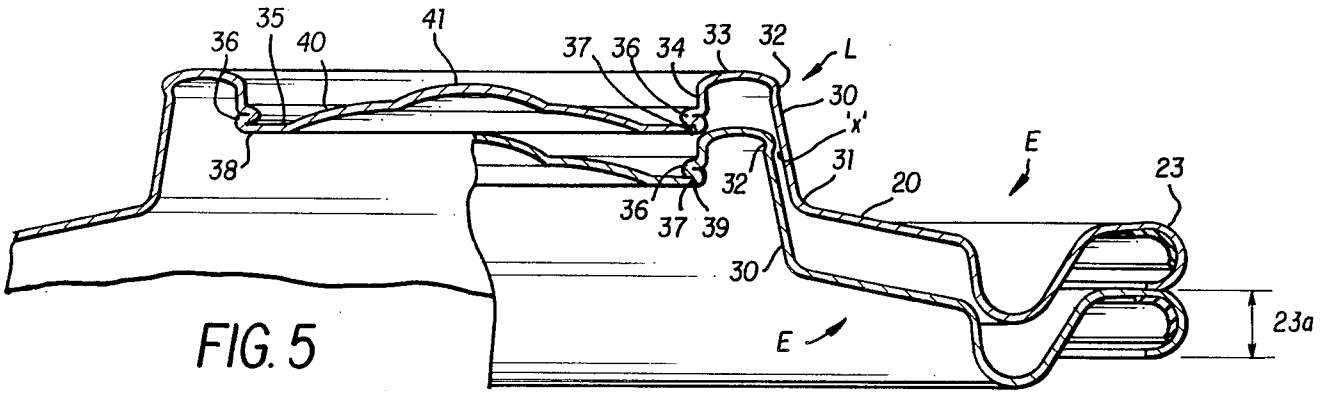
FIG. 5 is a partial sectional portion of a can end such as shown at FIG. 4 but on further enlarged scale and prior to its attachment to a can body, the Figure also showing a portion of an adjacent can end to illustrate the manner in which the can ends are nested together.
Figure 6:
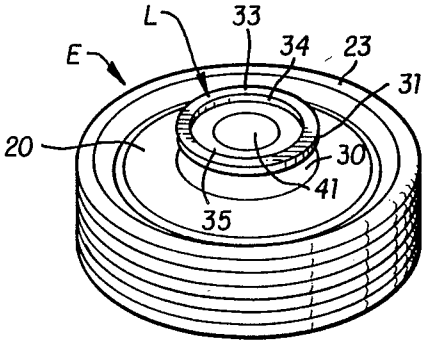
FIG. 6 is an isometric view of a number of ends nested together which is essential for storage, shipping and can closing, double seaming operations.

The peripheral portion of the can end E, where the connection is made to the can body, is conventional. FIG. 4 illustrates the can end so connected with the can body while FIG. 5 illustrates the can end E before it is connected to the can body C. It is important that the lipped opening L be constructed, in form and size, to be correlated with the peripheral end curl 23 (which will become the end hook **23*x*** when the can end and body are seamed together), all to permit a number of ends to nest together without interfering with each other. As is customary, a plurality of can ends E are nested together as in FIG. 6 for shipment, storage, and subsequent use when the ends are fed through a double seaming closure machine.

Figure 7:
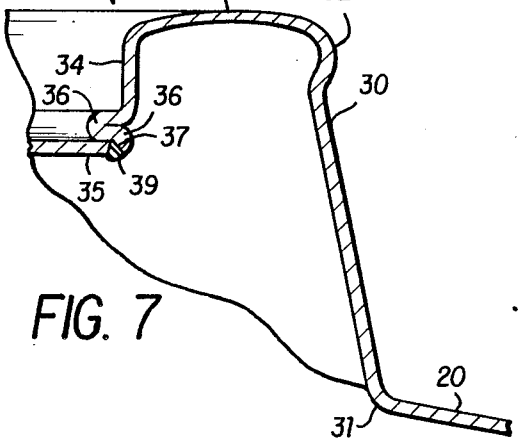
FIG. 7 is a fragmentary portion of the section shown at FIG. 2 but on a further enlarged scale to better illustrate the lipped opening and the construction of the triplefold pushdown gate.

The lipped opening L is axially centered in the expansion panel 20 of the end as heretofore indicated, to permit all components of the can end to be radially symmetrical for easy forming and drawing of the end with comparatively simple tooling. The opening L includes an outer wall 30 upstanding from the expansion panel 20 at a base radius 31. The wall 30 is inwardly inclined at a small angle from the vertical, i.e. a few degrees, and terminates at the top by a small bead 32 outstanding from the wall. This wall 30 is ringed by an inwardly projecting circular panel 33 which forms the top of the lip which is shown at FIGS. 4, 5 and 7 as being convexed upwardly a small amount, although this circular panel 33 may also be flat. The inner edge of this circular panel 33 turns downwardly to form an inner wall 34 of the lipped opening L. The inner wall 34 is thus spaced a short distance from the outer wall which permits the movement of forming tools between the walls. The inner wall 34 may extend downwardly from the circular panel 33 only a short distance which may be less than the nesting space provided by the end curl **23*a* as seen in FIG. 5**. It is to be noted that if the height of the inner wall is greater than the permitted nesting space, the wall must be tapered inwardly and downwardly to a reduced diameter to permit nesting of the ends.

The height of the outer wall 30 of the opening L will be greater than the permitted nesting space established by the diameter of the end curl **23*a*. As aforementioned, for easy drinking from the lipped opening L, a wall of any height is possible. However, a wall height of 0.15 to 0.50 inches was found to be adequate, and a wall height of 0.20 to 0.25 inches was found to be preferable. The height of the end curl 23*a* and the permitted nesting space will be ordinarily 0.075 to 0.085 inch. Accordingly, when nested together, the opening L of one can end E must telescope into the opening of the adjacent end as clearly illustrated at FIG. 5. To accomplish this, the angle at which the outer wall slopes can be easily established for a given end by taking into account the necessary insertion distance, the metal thickness and the projection of the bead 32 at the top of the wall 30. It is to be noted that the outer wall slope must be such as to permit nesting of the ends without the edge of the wall bead 32 of a lower end which projects into the lipped opening of an upper end interfering with the inner surface of the upper lipped opening L, as shown in FIG. 5** at "x". Otherwise, nested ends would fit too tightly to feed through a double seaming closing machine. In the industry, this resulting lateral freedom of movement by the spacing "x" is referred to as "shuffle."

Figure 8:
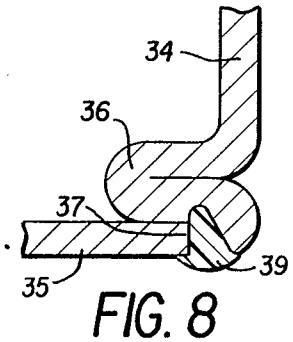
FIG. 8 is a fragmentary portion of the section shown at FIG. 7 but on a further enlarged scale to better show the triplefold and the manner in which a score cut separates the pushdown gate from the spout lip.

An opening gate 35 is positioned below the inner wall 34, preferably at the bottom fold of a triplefold 36 whose top fold is at the wall base. A score cut 37 at the underside of the triplefold 36 extends around most of the circumference of the triplefold 36 to form a separation edge, an uncut portion is at the remainder of the triplefold to form a hinge 38. A sealant 39, such as a hot melt or a plastisol, as shown in FIGS. 7 and 8 is deposited about the bottom of the triplefold and hermetically seals the opening gate 35 from leaks while it remains in place against the triplefold.

Downward finger pressure on the gate 35 will release it from the can end at the score cut 37 to swing it on the hinge 38 and into the can to effect the opening as illustrated in broken lines at FIG. 4. The triplefold 36 is described in U.S. Pat. Nos. 3,334,775 and 4,244,490. As emphasized in these patents, the triplefold 36 permits the score cut to be at a location where it is behind a folded safety rim. While a triplefold is preferable, other means for connecting the gate 35 to the inner wall can be used.

Figure 3:
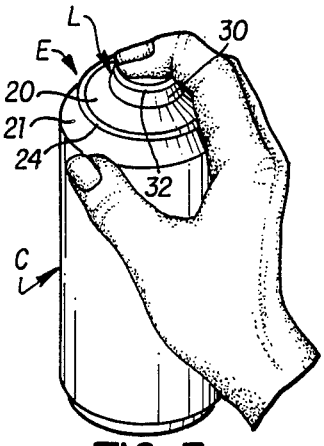
FIG. 3 is an isometric view of the can illustrated at FIG. 1 as being held with one hand and gripped in such a manner as to permit the can to be opened by the individual's index finger.

With the construction described, it is an easy matter to open a can. This may be done as a simple one-hand operation by gripping the can in such a manner as to place the individual's index finger on the closure gate 35 as illustrated in FIG. 3. To facilitate the opening of a can in this manner, the gate 35 may be dished upwardly as at 40 with an upward convex knob 41 at the apex of the upward dish as best shown at FIG. 5.

An important aspect of the present invention is the width of the circular panel 33. The panel 33 holds the outer wall 30 and the inner wall 34 apart in concentric relationship. The space between the two walls permits a cylindrical die component to move against the circular panel 33 in forming the can end and to shape the outer wall 30 and inner wall 34 independently of each other. Of significance too, the circular panel 33 facilitates the opening of the gate 35 whenever the outer wall 30 extends below the inner wall 34 as above mentioned. If the circular panel 33 were very narrow or eliminated, the closure gate 35 would then be against or closely adjacent to the inner surface of the outer wall 30. This would interfere with opening the gate. As the gate 35 is pushed downwardly, to swing on hinge 38, the peripheral, circular edge of the gate at each side of the hinge would engage the inner surface of the outer wall 30. It follows that the width of the circular panel 33 may be sufficient to permit the gate 35 to swing free of the lip wall 30. Selection of a suitable width for the circular panel 33 will pose no problem. A deep inner wall 34 or the spacer panel 42, at FIG. 13 and hereinafter described, will also obviate this interference. Predisposing the gate toward bending is also possible if interference exists.

Figure 9:
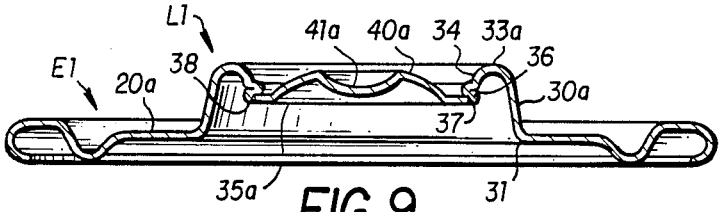
FIG. 9 is a sectional view similar to FIG. 4, but showing a can end before it is connected to a can body and showing a flat expansion panel with minor modifications to the lipped opening and pushdown gate.

Various alternate constructions and embodiments of this can end are possible as will be hereinafter described. FIG. 9 discloses a can end E1 differing from the construction shown at FIGS. 1 to 8 in minor detail. First, the expansion panel **20*a* of the end E1 is flat rather than being convexed upwardly. This shortens the overall height of the can with none or only a portion of the lipped opening L1 extending above the double seam rim 24. However, this flat expansion panel 20*a* does not change the peripheral seaming components of the can end which connect with the can body. Certain minor modifications of the opening L1 are shown at FIG. 9 which include the elimination of the bead 32 at the top of the outer lip wall 30*a*. The bead 32 is advantageous for better holding the lipped opening L1 when drinking or when pouring from the can. However, the opening can be used without this bead 32. Another variation involves the use of a modified upward convex dish 40*a* on the gate 35*a* which uses a cup 41*a* instead of a knob at the center of the dish 40*a* which may guide an individual's finger to the center of the gate 35*a***. Such minor differences are optional.

Figure 10:
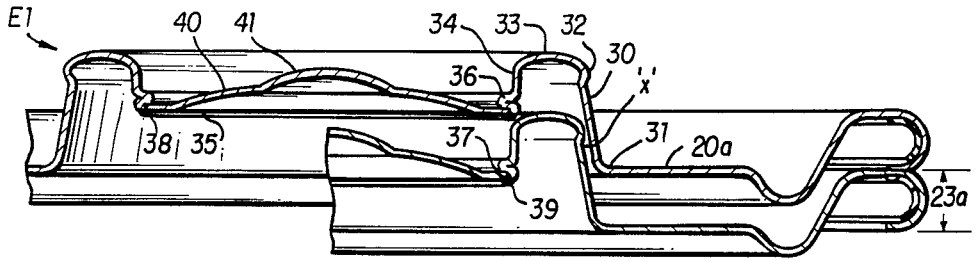
FIG. 10 is a partial sectional view similar to FIG. 5 but showing an end having a flat expansion panel such as shown at FIG. 9.

FIG. 10 is similar to FIG. 5 to illustrate that a group of can ends E1, modified by using a flat center panel **20*a***, can be nested together in the same way as heretofore described.

Figure 11:
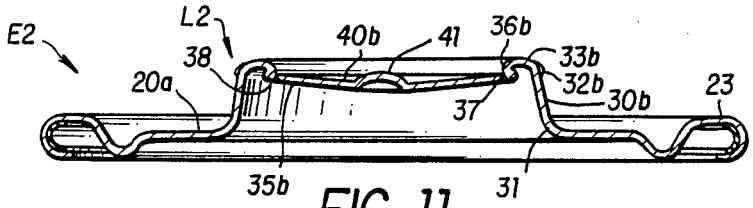
FIG. 11 is a sectional view similar to FIG. 9 showing a can end with a flat expansion panel and a modified arrangement for mounting the pushdown gate within the lipped opening.

FIG. 11 illustrates a further modification of the can end E2. The can end E2 is provided with a flat expansion panel **20*a* although a convexed expansion panel 20 (FIG. 5) may also be used. The end E2 is connected to a can body by peripheral seaming components as hereinbefore described. The lipped opening L2 is formed with an outer wall 30*b* upstanding from the expansion panel 20*a*. A bead 32*b* is provided about the top of wall 30*b*. A circular panel 33*b* caps the wall 30*b* and a triplefold 36*b* is at the inner edge of, and underneath, the circular panel 33*b*. This places the gate 35*b*, formed by the score cut 37 and the hinge 38, directly beneath the inner edge of the circular panel 33*b*. The gate 35*b* is concavely dished downwardly, as at 40*b*, to be well below the top 38*b* as a protection against being accidentally pushed open. A convex knob 41 may be provided at the center of the downwardly dished gate 40*b* for better finger engagement when the gate is to be opened. It is to be noted that the width of the top 33*b* may locate the hinge 38 away from the wall 30*b* a distance such that the edges of the gate 35*b* at each side of the hinge 38 will not engage the inner surface of the aperture wall 30*b* when the gate is pushed downwardly and to one side of the opening as it swings on the hinge 38**.

Figure 12:
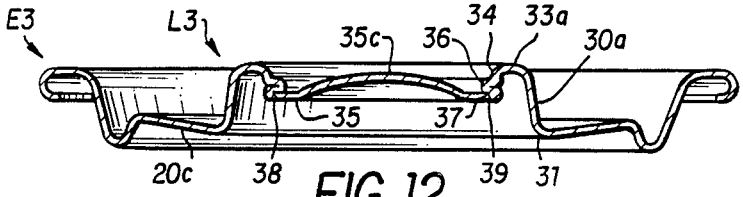
FIG. 12 is a sectional view similar to FIGS. 4 and 9 but with a concaved expansion panel to position the top of the lipped opening near the level of the seaming rim connecting the can end to the can body.

FIG. 12 discloses a can end E3 differing from the construction shown at FIGS. 4 and 9 in that the expansion panel **20*c* at the end E3 is concaved downwardly instead of being convexed upwardly or being flat as heretofore described. This end E3 is connected to a can body by peripheral seaming components as hereinbefore described. The construction of the opening L3 is essentially the same as the opening L1 shown at FIG. 9, although an upwardly dished gate 35*c* is shown. The basic construction of an end with a concaved expansion panel 20*c*** does not differ significantly from the other types described. Moreover, this end E3 is as easy to drink from and to pour from as the other ends described. A disadvantage is the difficulty in draining the contents of the can. The advantage is that a smaller projection or no projection of the lipped opening above the level of the outer top seam of the can is possible with a relatively shallow countersink.

Figure 13:
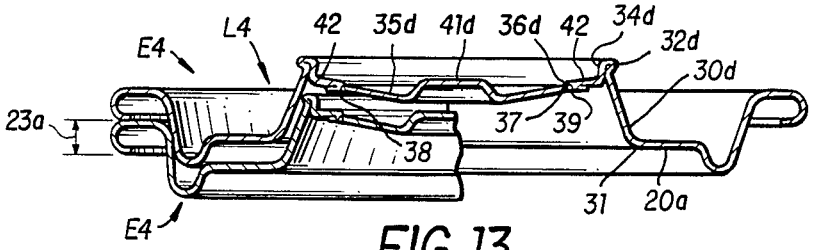
FIG. 13 is a sectional view similar to FIG. 9 but with a modified lipped opening and with a slight modification to the pushdown gate.

FIG. 13 discloses a can end E4 similar to the units heretofore shown and described but with a modified lip opening L4. This end is formed with a flat expansion panel **20*a* but it may be varied using, for example, a convexed expansion panel 20 as in FIG. A. The end E4 is connected to a can body by peripheral seaming components as heretofore described. The outer wall 30*d* of the lipped opening L4 may have a bead 32*d* about its top edge. From this bead, the metal is folded over the top edge of the wall 30*d* to place an inner wall 34*d* against or close to the inner side of the outer wall 30*d*. This inner wall 34*d* can project no further into the opening than that permitted by the nesting space of the ends, limited by the diameter of the curl height 23*a*, as shown by a portion of one end E4 being nested into the other. At the base of the inner wall 34*d***, a circular spacer panel 42 turns inwardly to reduce the size of the orifice within the lipped opening L4 and perform the same function as the inturned circular panel 33 of FIG. 4. A triplefold 36*d* is formed about the inner edge of this ring 42 to carry a gate 35*d* at a spacing from the inner surface of the wall 30*d* adequate to permit downward movement of the gate at its hinge, all as hereinbefore described. This closure gate 35*d* is shown as being concaved downwardly with a central knob 41*d* upstanding from the center of the gate but such may be varied. It is to be noted that this lipped opening has two advantages; first, it has less tendency to entrap air, and secondly, the wall 30*d* acts as a backstop when applying a sealer to the score cut.

The manner in which these ends are used is apparent from the foregoing descriptions. Thus, I have now described my invention in considerable detail. It is obvious that others skilled in the art can devise and build alternate and equivalent constructions which are within the spirit and scope of my invention. Therefore, I desire that my protection be limited, not by the constructions illustrated and described, but only by the proper scope of the appended claims.

I claim:

1. In a beverage can end of drawn metal with a peripheral connection means about the expansion panel of the can end adapted to connect the can end to a can body, the improvement comprising:
   (a) a lipped opening proportioned to facilitate drinking and pouring from a can, having a substantially vertical and circular wall upstanding from the expansion panel;
   (b) a gate seating and hinging means within the embrace of the lipped opening wall;
   (c) means connecting the seating and hinging means within the confines of the lip; and,
   (d) a closure gate at the underside of the gate seating and hinging means, seated thereto and being opened by pushing it to swing downwardly about the hinging means, as from the seating means and to one side of the lipped opening wall.

2. In a beverage can end of drawn metal with a peripheral connection means about the expansion panel of the can end adapted to connect the end to the can body, the improvement comprising:
   (a) a lipped opening proportioned to facilitate drinking and pouring from a can, having a substantially vertical outer wall upstanding from the expansion panel, and a circular panel bridging means within the outer wall, near the top thereof, having an outward edge joining the top of the outer wall and an inward edge forming a reduced diameter passageway in the lipped opening;
   (b) a closure gate at the inner edge of the bridging means having a diameter approximately the same as the diameter of the inner edge; and
   (c) a gate seating and hinging means at said inner edge with the gate being seated at the underside of the inner edge of the seating means and being opened by pushing it to swing downwardly at the hinging means from the seating means and to one side of the inner opening.

3. The can end defined in claim 2, wherein the diameter of the inner edge opening and the width of the bridging means is such that the edge of the gate, at each side of the hinge, will not engage any portion of the inner surface of the outer wall which is below the inner edge opening.

4. The can end defined in claim 2, wherein the gate hinging and seating means is a circular triplefold formed at the inner edge of the bridging means and the gate is a circular disc embraced by the bottom fold of the triplefold and is defined by a score cut at the bottom fold but leaving a short uncut portion to constitute a hinge.

5. The can end defined in claim 4, wherein the gate disc is convexed.

6. The can end defined in claim 4, wherein the gate disc is concaved.

7. The can end defined in claim 4, wherein gate disc is flat.

8. The can end defined in claim 5, including a button at the center of the gate.

9. The can end defined in claim 6, including a button at the center of the gate.

10. The can end defined in claim 7, including a button at the center of the gate.

11. The can end defined in claim 2, wherein the can end expansion panel is convexed upwardly with the lipped opening being at the apex thereof.

12. The can end defined in claim 2, wherein the can end expansion panel is concaved downwardly a distance sufficient to obviate the projection of the top of the lipped opening above the elevation of the top seam of the can.

13. The can end defined in claim 2, wherein the can end expansion panel is flat.

14. The can end defined in claim 13, wherein the lipped opening is at the center of the flat expansion panel with all components of the can end being radially symmetrical.

15. The cam end defined in claim 2, including a small outstanding bead at the top of the outer wall.

16. The can end defined in claim 2, wherein the lipped opening outer wall, upstanding from the expansion panel, may be of any desired height.

17. The can end defined in claim 2, wherein the height of the lipped opening outer wall, upstanding from the expansion panel, is in the range of 0.15 to 0.50 inches.

18. The can end defined in claim 1, wherein a number of can ends are adapted to nest together with the permitted nesting spacings being substantially less than the height of the lipped opening, and wherein the lipped opening outer wall is inclined slightly from the vertical and from a minimum diameter at the top of the outer wall to a larger diameter base at the expansion panel, whereby to permit the top portion of the lipped opening of one can end to telescope into the base portion of an adjacent can end when the can ends are nested together.

19. The can end defined in claim 2, wherein a number of can ends are adapted to nest together with the permitted nesting spacings being substantially less than the height of the lipped opening, and wherein the lipped opening outer wall is inclined slightly from the vertical and from a minimum diameter at the top of the outer wall to a larger diameter base at the expansion panel, whereby to permit the top portion of the lipped opening of one can end to telescope into the base portion of an adjacent can end when the can ends are nested together.

20. The can end defined in claim 18, wherein the spacing of said bridging means from the top of the lipped opening outer wall and into the lipped opening is less than the permitted nesting spacings of a plurality of can ends, whereby the bridging means will not interfere with nesting of the ends together.

21. The can end defined in claim 19, wherein the spacing of said bridging means from the top of the lipped opening outer wall and into the lipped opening is less than the permitted nesting spacings of a plurality of can ends, whereby the bridging means will not interfere with nesting of the ends together.

22. The can end defined in claim 2, wherein the bridging means comprises an inner wall having a height substantially less than the height of the outer wall and a circular panel top having its outer edge connecting with the top of the outer wall and its inner edge connecting with the top of the inner wall to hold the walls in a spaced concentric relationship, and wherein the gate seating means is at the bottom of the inner wall.

23. The can end defined in claim 2, wherein the bridging means comprises a circular panel top having its outer edge connecting with the top of the outer wall, and its inner edge connecting with the gate seating means.

24. The can end defined in claim 22, wherein the ring-shaped top is radially arched.

25. The can end defined in claim 23, wherein the ring-shaped top is radially arched.

26. The can end defined in claim 2, wherein the bridging means comprises an inner wall whose top connects with the top of the outer wall and extends a short distance into the outer wall, alongside the outer wall, and a bottom spacer panel having its outer edge connecting with the bottom of the inner wall and its inner edge connecting with the gate seating means.

27. In a beverage can end of drawn metal with a peripheral connection means about the expansion panel of the can end for connection to a can body, the improvement comprising:

(a) a double-walled, lipped opening proportioned to facilitate drinking and pouring from a can, with a substantially vertical outer wall upstanding from the expansion panel, an inner wall having a height substantially less than the height of the outer wall and being positioned adjacent to the top of the outer wall, and a circular panel top having its outer edge connecting with the top of the outer wall and its inner edge connecting with the top of the inner wall to hold the outer and inner walls in a spaced concentric relationship;

(b) a gate at the bottom of the inner wall having a diameter approximately the same as the inner wall diameter; and (c) a gate seating and hinging means at the bottom of the inner wall with the gate seated at the underside of the seating means and being opened by pushing it to swing downwardly about the hinging means from the seating means and to one side of the inner wall.

28. The can end defined in claim 27, wherein the diameter of the inner wall and corresponding width of the circular panel is such that, as the gate is opened the sides of the gate will not engage the inner surface of the outer wall.

29. The can end defined in claim 27, wherein the gate hinging and seating means is a circular triplefold at the bottom of the inner wall and the gate is formed by a score cut about the bottom fold of the triplefold but leaving a short uncut portion to form a hinge.

30. In a beverage can end of drawn metal with a peripheral connection means about the expansion panel of the can end for connection to a can body, the improvement comprising:

(a) a lipped opening proportioned to facilitate drinking and pouring from a can with a substantially vertical, outer wall upstanding from the expansion panel and a circular panel top having its outer edge connecting with the top of the outer wall and its inner edge forming a reduced diameter passageway in the lipped opening;

(b) a closure gate at the underside of the inner edge of the circular panel top and having a diameter approximately the same as the diameter of the inner edge of the top; and (c) a gate seating and hinging means at the inner edge of the top with the gate seated at the underside of the seating means and being opened by pushing it to swing downwardly about the hinging means from the seating means and to one side of the inner edge opening.

31. The can end defined in claim 30, wherein the gate hinging and seating means is a circular triplefold at the underside and at the inner edge of the circular panel top and the gate is formed by a score cut about the bottom fold of the triplefold but leaving a short uncut portion to form a hinge.

32. In a beverage can of drawn metal with a peripheral connection means about the expansion panel of the can end for connection to a can body, the improvement comprising:

(a) a lipped opening proportioned to facilitate drinking and pouring from a can with a substantially vertical outer wall upstanding from the expansion panel, an inner wall whose top connects with the top of the outer wall and which extends into and alongside the outer wall, and a spacer panel having its outer edge connecting with the bottom of the inner wall and its inner edge forming a reduced diameter passageway in the lipped opening;

(b) a closure gate at the inner edge of the spacer panel having a diameter approximately the same as the diameter of the inner edge of the spacer panel; and (c) a gate seating and hinging means at the inner edge of the spacer panel with the gate seated at the underside of the seating means and being opened by pushing it to swing downwardly at the hinging means and to one side of the inner edge opening of the spacer panel.

33. The can end defined in claim 32, wherein the gate hinging and seating means is a circular triplefold at the underside and at the inner edge of the spacer panel and the gate is formed by a score cut about the bottom fold of the triplefold but leaving a short uncut portion to form a hinge.

* * * * *

UNITED STATES PATENT AND TRADEMARK OFFICE

CERTIFICATE OF CORRECTION

PATENT NO. : B1 4,976,368
DATED : September 10, 1996
INVENTOR(S) : Gerald B. Klein It is certified that error appears in the above-identified patent and that said Letters Patent is hereby corrected as shown below:

Claim 18, col. 2, line 48, "proportiond" should read --proportioned--.

Claim 19, col. 3, line 28, "inclineed" should read --inclined--;

line 31, "lippd" should read --lipped--.

Claim 30, col. 4, line 38, "cicular" should read --circular--.

Claim 39, col. 6, line 29, "diameter and" should read --diameter; and--.

Signed and Sealed this

Twenty-fourth Day of March, 1998

*Attest:*

Bruce Lehman

BRUCE LEHMAN

*Attesting Officer*

*Commissioner of Patents and Trademarks*

US004976368B1

REEXAMINATION CERTIFICATE (2989th)

United States Patent [19] [11] B1 4,976,368

Klein [45] Certificate Issued Sep. 10, 1996

[54] CONCENTRIC CONVENIENCE OPENING BEVERAGE CAN END

[76] Inventor: Gerald B. Klein, 13451 Stuart Ct., Broomfield, Colo. 80020

Reexamination Request:
No. 90/003,500, Jul. 18, 1994

Reexamination Certificate for:

| | |
|---|---|
| Patent No.: | **4,976,368** |
| Issued: | **Dec. 11, 1990** |
| Appl. No.: | **425,309** |
| Filed: | **Oct. 23, 1989** |

[51] Int. Cl.[6] ..... B65D 17/32
[52] U.S. Cl. ..... 220/268; 220/380; 222/541.6
[58] Field of Search ..... 220/266, 267, 220/268, 269, 271, 380, 906; 222/541

[56] References Cited

U.S. PATENT DOCUMENTS

| | | | |
|---|---|---|---|
| 2,120,186 | 6/1938 | Punte | 220/274 |
| 3,334,775 | 8/1967 | Klein et al. | 220/268 |
| 3,795,206 | 2/1974 | DeLine et al. | 220/268 |
| 3,929,251 | 12/1975 | Urmston | 220/268 |
| 3,931,890 | 1/1976 | Davis | 206/508 |
| 4,244,489 | 1/1981 | Klein | 220/268 |
| 4,244,490 | 1/1981 | Klein | 220/268 |
| 4,574,975 | 3/1986 | Taylor et al. | 220/306 |

*Primary Examiner*—Stephen Cronin

[57] ABSTRACT

A beverage can end of drawn metal is provided with a lipped opening upstanding from the expansion panel of the end. The expansion panel may be convex, flat or concave. The lipped opening is proportioned to facilitate drinking and pouring from a can. A height of the lip of 0.25 inches is sufficient for this purpose. The lip is formed as a circular wall with a pushdown gate positioned within the lip, the gate being mounted on a seating and hinging means which preferably is a triplefold of drawn metal. The hinging and seating means within the lip is of a smaller diameter than the lip wall, and is supported by a bridging means connecting with the top of the lip wall. The bridging means includes a circular panel and may include an inner wall portion. In a first embodiment, the circular panel is the top of the lipped opening and the seating and hinging means is at the base of an inner wall, whose top is at the inner edge of the circular panel to space the inner wall from the outer wall. In a second embodiment, the inner wall is not present and the seating and hinging means is at the inner edge of the circular panel and at the top of the lipped wall. In a third embodiment, an inner wall is closely adjacent to the top portion of the lip wall and a circular spacer panel extends inwardly from the bottom of the inner wall to carry the seating and hinging means at its inner edge.

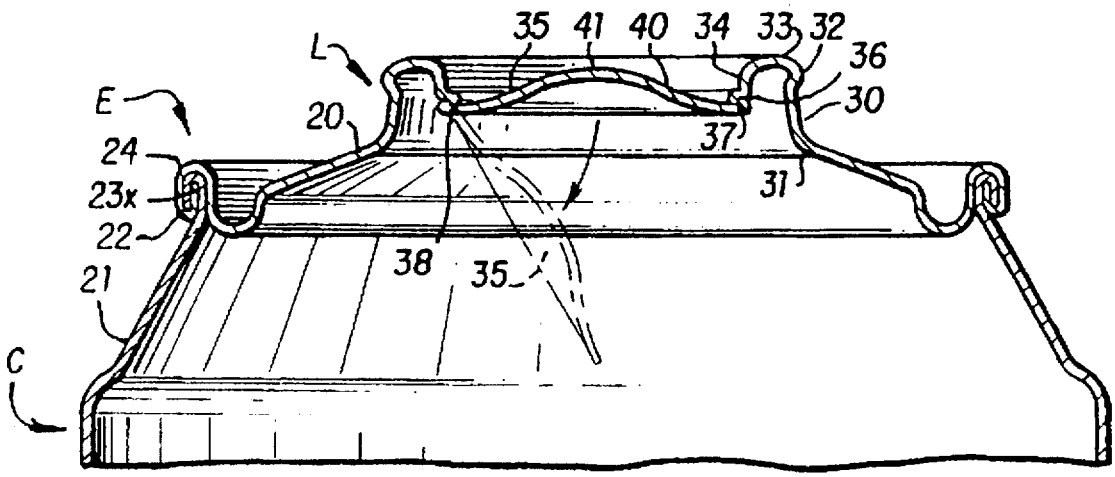

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 6, lines 53–68:

FIG. 13 discloses a can end E4 similar to the units heretofore shown and described but with a modified lip opening L4. This end is formed with a flat expansion panel 20a but it may be varied using, for example, a convexed expansion panel 20 as in FIG. [A] *4*.The end E4 is connected to a can body by peripheral seaming components as heretofore described. The outer wall 30d of the lipped opening L4 may have a bead 32d about its top edge. From this bead, the metal is folded over the top edge of the wall 30d to place an inner wall 34d against or close to the inner side of the outer wall 30d. This inner wall 34d can project no further into the opening than that permitted by the nesting space of the ends, limited by the diameter of the curl height 23a, as shown by a portion of one end E4 being nested into the other. At the base of the inner wall 34d, a circular spacer panel

AS A RESULT OF REEXAMINATION, IT HAS BEEN DETERMINED THAT:

Claims 16 and 31 are cancelled.

Claims 1–4, 18–20, 22–25, 27, 29, 30, 32 and 33 are determined to be patentable as amended.

Claims 5–15, 17, 21, 26 and 28, dependent on an amended claim, are determined to be patentable.

New claims 34–39 are added and determined to be patentable.

1. In a beverage can end of drawn metal with a peripheral connection means about the expansion panel of the can end adapted to connect the can end to a can body, the improvement comprising:

(a) a lipped opening proportioned to facilitate drinking and pouring from a can, [having] *the lipped opening including* a substantially vertical and circular wall upstanding from the expansion panel;

(b) [a gate seating and hinging means within the embrace of] *a radially-extending annular flange spaced radially inwardly from* the [lipped opening] wall *and defining a passageway for drinking and pouring*;

(c) means *within the perimeter of the outer wall* connecting the [seating and hinging means within the confines of the lip] *annular flange and the outer wall*; and (d) a closure gate [at the underside of the gate seating and hinging means,] *for the passageway* seated [thereto] *at its periphery on the underside of the annular flange and* being [opened by pushing it] *hinged to the annular flange* to swing downwardly [about the hinging means, as from the seating means and] to one side of the [lipped opening wall] *passageway when opened by pushing*.

2. In a beverage can end of drawn metal with a peripheral connection means about the expansion panel of the can end adapted to connect the end to the can body, the improvement comprising:

(a) a lipped opening proportioned to facilitate drinking and pouring from a can, [having] *the lipped opening including* a substantially vertical outer wall upstanding from the expansion panel, and a circular panel bridging means *disposed* within the *perimeter of the* outer wall[, near the top thereof, having] *and extending radially inwardly from* an outward edge joining the top of the outer wall [and] *to* an inward edge forming a reduced diameter passageway in the lipped opening *for drinking and pouring*;

(b) a closure gate [at the inner edge] having [a] *an annular periphery, the* diameter *thereof being* approximately the same as the diameter of the [inner] *inward* edge *of the bridging means*; and (c) [a gate seating and hinging means at said inner] *an annular flange integrally formed with the inward* edge [with] *of the bridging means,* the *closure* gate being *hinged to and* seated at the underside of the [inner edge of the seating means] *annular flange* and being opened by pushing it to swing downwardly at the [hinging means] *hinge* from the [seating means and] *annular flange* to one side of the [inner opening] *passageway*.

3. The can defined in claim 2, wherein the diameter of the [inner] *inward* edge [opening] and the *radial* width of the bridging means [is] *are* such that the [edge] *periphery* of the gate, at each side of the hinge, will not engage any portion of the inner surface of the outer wall which is below the [inner] *inward* edge [opening].

4. The can end defined in claim 2, wherein the [gate hinging and seating means] *annular flange* is a circular triplefold formed at the [inner] *inward* edge of the bridging means and the gate is a circular disc embraced by the bottom fold of the triplefold and [is] defined by a score cut at the bottom fold [but leaving], *the hinge being* a short uncut portion [to constitute a hinge] *of the bottom fold*.

18. [The can end defined in claim 1,] *In a beverage can end of drawn metal with a peripheral connection means about the expansion panel of the can end adapted to connect the can end to a can body, the improvement comprising:*

*(a) a lipped opening proportiond to facilitate drinking and pouring from a can, the lipped opening including a substantially vertical and circular wall upstanding from the expansion panel;*

*(b) a gate seating and hinging means within the embrace of the lipped opening wall;*

*(c) means connecting the seating and hinging means within the confines of the lip; and*

*(d) a closure gate at the underside of the gate seating and hinging means, seated thereto and being opened by pushing it with a finger to swing downwardly about the hinging means from the seating means to one side of the lipped opening wall;* wherein a number of can ends are adapted to nest together with the permitted nesting spacings being substantially less than the height of the lipped opening, and wherein the lipped opening outer wall is inclined slightly from the vertical and from a minimum diameter at the top of the outer wall to a larger diameter base at the expansion panel, whereby to permit the top portion of the lipped opening of one can end to telescope into the base portion of an adjacent can end when the can ends are nested together.

19. [The can end defined in claim 2,] *In a beverage can end of drawn metal with a peripheral connection means about the expansion panel of the can end adapted to connect the end to the can body, the improvement comprising:*

(*a*) *a lipped opening proportioned to facilitate drinking and pouring from a can, the lipped opening including a substantially vertical outer wall continuous with and upstanding from the expansion panel, and a circular panel bridging means within the outer wall, near the top thereof, having an outward edge joining the top of the outer wall and an inward edge forming a reduced diameter passageway in the lipped opening;*

(*b*) *a closure gate at the inward edge of the bridging means having a diameter approximately the same as the diameter of the inward edge; and*

(*c*) *a gate seating and hinging means at said inner edge with the gate being seated at the underside of the inward edge of the seating means and being opened by pushing it with a finger to swing downwardly at the hinging means from the seating means and to one side of the inner opening,* wherein a number of can ends are adapted to nest together with the permitted nesting spacings being substantially less than the height of the lipped opening, and wherein the lipped opening outer wall is inclineed slightly from the vertical and from a minimum diameter at the top of the outer wall to a larger diameter base at the expansion panel, whereby to permit the top portion of the lippd opening of one can end to telescope into the base portion of an adjacent can end when the can ends are nested together.

20. The can end defined in claim 18, wherein the spacing [of said bridging means] from the top of the lipped opening outer wall [and into the lipped opening] *to the gate seating and hinging means within the embrace of the lipped opening* is less than the permitted nesting spacings of a plurality of can ends, whereby the bridging means will not interfere with nesting of the ends together.

22. The can end defined in claim 2, wherein the bridging means comprises an inner wall having a height substantially less than the height of the outer wall and a circular panel top having its outer edge connecting with the top of the outer wall and its inner edge connecting with the top of the inner wall to hold the walls in a spaced concentric relationship, and wherein the [gate seating means] *annular flange* is at the bottom of the inner wall.

23. The can end defined in claim 2, wherein the bridging means comprises a circular panel top having its outer edge connecting with the top of the outer wall, and its inner edge connecting with the [gate seating means] *annular flange*.

24. The can end defined in claim 22, wherein the [ring-shaped] *panel* top is [radially] *upwardly* arched.

25. The can end defined in claim 23, wherein the [ring-shaped] *panel* top is [radially] *upwardly* arched.

27. In a beverage can end of drawn metal with a peripheral connection means about the expansion panel of the can end for connection to a can body, the improvement comprising:

(a) a double-walled, lipped opening proportioned to facilitate drinking and pouring from a can, [with] *the lipped opening including* a substantially vertical outer wall upstanding from the expansion panel, an inner wall having a height substantially less than the height of the outer wall and being positioned [adjacent] *in inwardly radially-spaced relation* to the [top of the] outer wall, and a circular panel top having its outer edge connecting with the top of the outer wall and its inner edge connecting with the top of the inner wall to hold the outer and inner walls in a spaced concentric relationship, *the inner wall, outer wall and panel top being integrally formed in one piece*;

(b) a gate at the bottom of the inner wall having a diameter approximately the same as the inner wall diameter; and (c) [a gate seating and hinging means at] *an annular flange integrally connected in one piece with and radially extending from* the bottom of the inner wall [with], the gate *being hinged to and* seated at the underside of the [seating means] *annular flange* and being opened by pushing it *with a finger* to swing downwardly about the [hinging means] *hinge* from the [seating means and] *annular flange* to one side of the inner wall.

29. The can end defined in claim 27, wherein the [gate hinging and seating means] *annular flange* is a circular triplefold at the bottom of the inner wall [and], the gate is formed by a score cut about the bottom fold of the triplefold [but leaving] *and the hinge is* a short uncut portion [to form a hinge] *of the bottom fold.*

30. In a beverage can end of drawn metal with a peripheral connection means about the expansion panel of the can end for connection to a can body, the improvement comprising:

(a) a lipped opening proportioned to facilitate drinking and pouring from a can [with], *the lipped opening including* a substantially vertical, outer wall upstanding from the expansion panel and a circular panel top *disposed within the perimeter of the outer wall, the panel top* having [its] *an* outer edge connecting with the top of the outer wall and [its] *an* inner edge [forming] *radially inwardly spaced from the outer wall and defining* a reduced diameter passageway in the lipped opening, *the diameter of passageway being selected to permit drinking and pouring therefrom*;

(b) a closure gate at the underside of the inner edge of the cicular panel top and having a diameter approximately the same as the diameter of the inner edge of the top; [and]

(c) [a gate seating and hinging means at] *a circular triplefold integrally connected in one piece with* the inner edge of the top [with the gate], *the gate being formed by a score cut about the bottom fold of the triplefold and being* seated at the underside of the [seating means] *middle fold of the triple fold:* and (*d*) *a hinge formed by a short uncut portion in the bottom fold, the gate* being opened by pushing it to swing downwardly about the [hinging means] *hinge* from the [seating means and] *middle fold* to one side of the [inner edge opening] *passageway.*

32. In a beverage can of drawn metal with a peripheral connection means about the expansion panel of the can end for connection to a can body, the improvement comprising:

(a) a lipped opening proportioned to facilitate drinking and pouring from a can [with], *the lipped opening including* a substantially vertical outer wall upstanding from the expansion panel *to an annular top,* an inner wall [whose top connects with] *connected at its top to* the *annular* top of the outer wall [and which extends into and alongside the outer wall] *and extending to an annular bottom, the inner wall being radially inward of and annularly adjacent to the outer wall,* and a spacer panel [having its] *entirely disposed within the perimeter of the outer wall and extending radially inwardly from an annular* outer edge [connecting with] *con-*

*nected to* the *annular* bottom of the inner wall [and its] *to an annular* inner edge forming a reduced diameter passageway in the lipped opening;

(b) a closure gate at the *annular* inner edge of the spacer panel having a diameter approximately the same as the diameter of the inner edge of the spacer panel; [and]

(c) [a gate seating and hinging means at] *an annular flange formed integrally with* the inner edge of the spacer panel [with], the gate *being* seated at the underside of the [seating means] *annular flange;* and (*d*) *a hinge connecting the gate to the annular flange, the gate* being opened by pushing it to swing downwardly at the [hinging means] *hinge* and to one side of the [inner edge opening of the spacer panel] *passageway.*

33. The can end defined in claim 32, wherein the [gate hinging and seating means] *annular flange* is a circular triplefold at the underside and at the inner edge of the spacer panel, [and] the gate [is] *being* formed by a score cut about the bottom fold of the triplefold [but leaving] *and the hinge being defined by* a short uncut portion [to form a hinge] *of the bottom fold.*

*34. The can end defined in claim 1 wherein the closure gate is separated from the annular flange over a portion of its periphery and including a sealant positioned to prevent leaks until the gate is opened.*

*35. The can end defined in claim 1 wherein the lipped opening has a predetermined height and wherein the upstanding wall and connecting means are positioned to permit the can ends to nest with a predetermined nesting spacing that is substantially less than the height of the lipped opening.*

*36. The can end defined in claim 2 wherein the closure gate is separated from the annular flange over a portion of its periphery and including a sealant positioned to prevent leaks until the gate is opened.*

*37. The can end defined in claim 2 wherein the lipped opening has a predetermined height and wherein the outer wall and bridging means are positioned to permit the can ends to nest with a predetermined nesting spacing that is substantially less than the height of the lipped opening.*

*38. The can defined in claim 2 wherein the lipped opening has a predetermined height and wherein the outer wall and bridging means define an inverted annular opening for telescopically receiving the outer wall and bridging means of an adjacent nesting can end, the nesting spacing between adjacent can ends being substantially less than the height of the lipped opening.*

*39. In a beverage can end of drawn metal with a peripheral connection means about the expansion panel of the can end for connection to a can body, the improvement comprising:*

(*a*) *a double-walled, lipped opening proportioned to facilitate drinking and pouring from a can with a substantially vertical outer wall upstanding from the expansion panel, an inner wall having a height substantially less than the height of the outer wall and being positioned adjacent to the top of the outer wall, and a circular panel top having its outer edge connecting with the top of the outer wall and its inner edge connecting with the top of the inner wall to hold the outer and inner walls in a spaced concentric relationship;*

(*b*) *a gate at the bottom of the inner wall having a diameter approximately the same as the inner wall diameter and*

(*c*) *a gate seating and hinging means at the bottom of the inner wall with the gate seated at the underside of the seating means and being opened by pushing it to swing downwardly about the hinging means from the seating means and to one side of the inner wall, wherein at least a portion of the closure gate is separated from the gate seating means when seated thereon and a sealant is positioned to prevent leaks until the gate is opened.*

* * * * *